US006485346B1

(12) United States Patent
Makhov

(10) Patent No.: US 6,485,346 B1
(45) Date of Patent: Nov. 26, 2002

(54) FIELD EMITTER FOR MICROWAVE DEVICES AND THE METHOD OF ITS PRODUCTION

(75) Inventor: Vladimir Makhov, Williamsport, PA (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 09/580,178

(22) Filed: May 26, 2000

(51) Int. Cl.[7] ..... H01J 9/02
(52) U.S. Cl. ..... 445/58; 445/24
(58) Field of Search ..... 445/58, 24, 6, 445/50, 51; 427/123, 126.1, 58; 29/424

(56) References Cited

U.S. PATENT DOCUMENTS

| | | | |
|---|---|---|---|
| 2,412,824 | A | 12/1946 | McArthur |
| 2,437,240 | A | 3/1948 | Brown |
| 2,826,719 | A | 3/1958 | Donal, Jr. |
| 2,928,987 | A | 3/1960 | Peters, Jr. |
| 3,121,822 | A | 2/1964 | Boyd |
| 3,297,901 | A | 1/1967 | MacDonald et al. |
| 3,646,388 | A | 2/1972 | Dudley et al. |
| 3,896,332 | A | 7/1975 | Heathcote |
| 3,899,714 | A | 8/1975 | Esterson et al. |
| 3,988,636 | A | 10/1976 | Sato et al. |
| 5,280,218 | A | 1/1994 | Smith |
| 5,348,934 | A | 9/1994 | Shaw |
| 5,382,867 | A | 1/1995 | Maruo et al. |
| 5,463,271 | A | 10/1995 | Geis et al. |
| 6,005,347 | A | 12/1999 | Lee |

FOREIGN PATENT DOCUMENTS

| | | |
|---|---|---|
| EP | 0 535 953 A2 | 4/1993 |
| GB | 2317741 | 12/1996 |
| GB | 2 308 224 | 6/1997 |
| RU | A98715 | 9/1976 |
| RU | 2051439 | 1/1993 |
| RU | 2115193 | 3/1994 |
| SU | 320 852 A | 11/1972 |
| WO | WO95/26039 | 3/1995 |
| WO | 95 26039 | 9/1995 |

*Primary Examiner*—Kenneth J. Ramsey
*Assistant Examiner*—Joseph Williams
(74) *Attorney, Agent, or Firm*—Lowe Hauptman Gilman & Berner, LLP

(57) ABSTRACT

The present invention relates to electronics and particularly to field emitters used in M-type microwave devices. The design of a multi-layer field emitter is proposed which has at least one operating film and supporting films, providing mechanical strength and preventing penetration of corrosive materials into the operating film at high operating temperatures. The supporting films could be produced from the same material or material with linear expansion coefficients equal or close to that of the operating film material. Built-in mechanical stress can cause not only deformation but also a break of the film during its exploitation in a wide range of temperatures. In the inventive structure the thermal stresses in the operating film during an emission from its surface are lower due to good thermal contact with supporting films.

13 Claims, 5 Drawing Sheets

FIELD EMITTER FOR MICROWAVE DEVICES AND THE METHOD OF ITS PRODUCTION

RELATED APPLICATIONS

The present application is related to co-pending patent application Ser. No. 09/380,247, entitled "M-TYPE MICROWAVE DEVICE", filed Aug. 30, 1999 and patent application Ser. No. 09/380,248, entitled "MAGNETRON", filed Aug. 30, 1999, both of which are hereby incorporated by reference into this specification in their entirety.

FIELD OF THE INVENTION

The present invention relates generally to the field of electronics, and more particularly, to field emitters used in M-type microwave devices.

BACKGROUND OF THE INVENTION

Well known are microwave devices such as that disclosed in Russian Patent N 2007777, which have field emission cathodes having interfaces for the purpose of preventing of thermal diffusion of corrosively active materials. These interfaces are shaped as discs made of thicker material which are placed on both sides of field emitter operating film made of foil of 0.5 to 5 $\mu$ thick. One of the drawbacks of Russian Patent '777 is a limitation of the thickness of the foil used as the field emitter. It is just impossible to assemble such emitter at a definite thickness of the foil. Besides, non-uniform thermal contact between the operating film and protective discs along the circumference does not allow heat to be effectively carried off from the field emitter during its operation. This may lead to damage of the field emitter because of overheating and melting.

Also known are other types of microwave devices such as that disclosed in Russian Patent N 1780444 where a two-layer structure, consisting of the field emitter operating film applied on the foil substrate, is used as a field emitter. The basic drawback of Russian Patent '444 is that one side of the operating film is not protected from mechanical and diffusion processes effecting the film both during assembly and operation of device. This reduces its mechanical strength and reliability as well as lifetime of the whole field emitter.

SUMMARY OF THE INVENTION

It is, therefore, an object of the present invention to provide a field emitter having lower built-in mechanical stress than prior art field emitters.

The present invention relates to electronics and particularly to field emitters used in M-type microwave devices. The design of a multi-layer field emitter is proposed which has at least one operating film and supporting films, providing mechanical strength and preventing penetration of corrosion materials into the operating film at high operating temperatures. The supporting films could be produced from the same material or material with linear expansion coefficients equal or close to that of the operating film material. Built-in mechanical stress can cause not only deformation but also a break of the film during its exploitation in a wide range of temperatures. In the inventive structure the thermal stresses in the operating film during an emission from its surface are lower due to good thermal contact with supporting films.

General advantages of the field emitter of the present invention compared to the prior art is that the present invention is mechanically stronger and more reliable which makes the cathode assembly easier. The present invention has a minimum of mechanical tensions which provides safe operation in a wide temperature range. The present invention provides operation at the contact with corrosively active materials under high temperature.

The operating film of the field emitter of the present invention could be as thin as a few angstroms which provides using this design in a variety of devices. At the same time, supporting films have a direct contact with the operating film which allows carrying off heat effectively from the emitter during its operation.

Production of the described field emitters is based on well developed technological processes used in mass production of thin film circuits and allows to make on their base inexpensive mono- and multi-emitter systems.

These and other objects of the present invention are achieved by a method of manufacturing a field emitter for a magnetron including depositing three layers of film on a substrate, placing at least one protective mask on an uppermost layer of three layers, etching the three layers not protected by the at least one protective mask, exposing horizontal and vertical portions of the first and third layers of the remaining three layers, and removing the protective mask and the substrate leaving at least one field emitter.

The foregoing objects of the present invention are achieved by a method of manufacturing a field emitter for a magnetron including depositing three layers of film on a substrate, placing at least one protective mask on an uppermost layer of the three layers, etching the three layers not protected by the at least one protective mask, depositing an additional film layer, partially etching the first of the three layers of film, removing the layers of film and photoresist above the partially etched layer, depositing a layer of film on the remaining partially etched layer and the additional layer, removing the partially etched layer and the layer of film above the partially etched layer, sputtering additional areas corresponding in shape to the remaining etched layer, and building up an additional layer depositing an additional layer on the sputtered areas.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
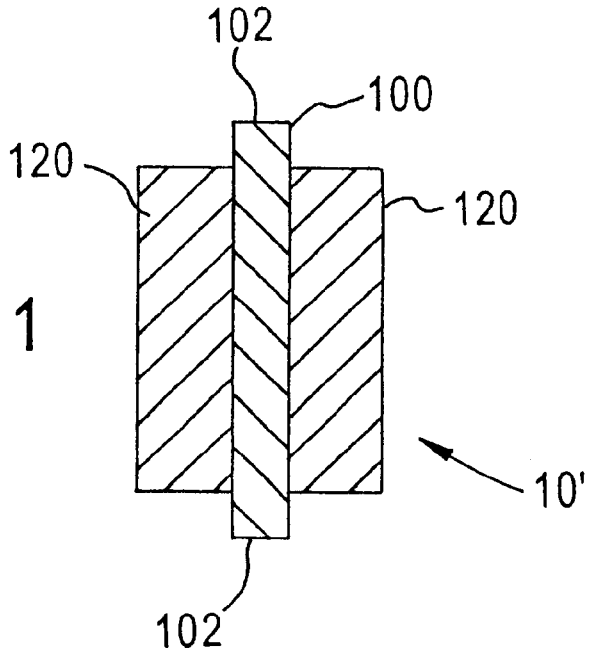
FIG. 1 is a cross-sectional view of the field emitter including operating film and side supporting films made of different material.
Figure 2:
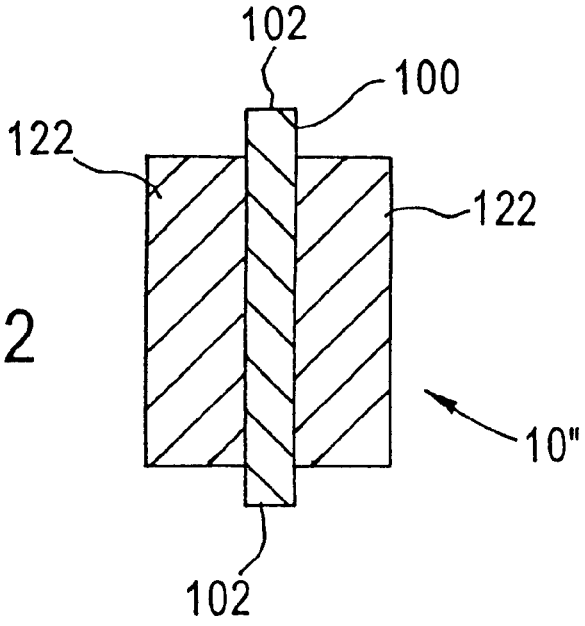
FIG. 2 is a cross-sectional view of a field emitter similar to FIG. 1 except that the operating film and the side supporting films are made of the same material.
Figure 3:
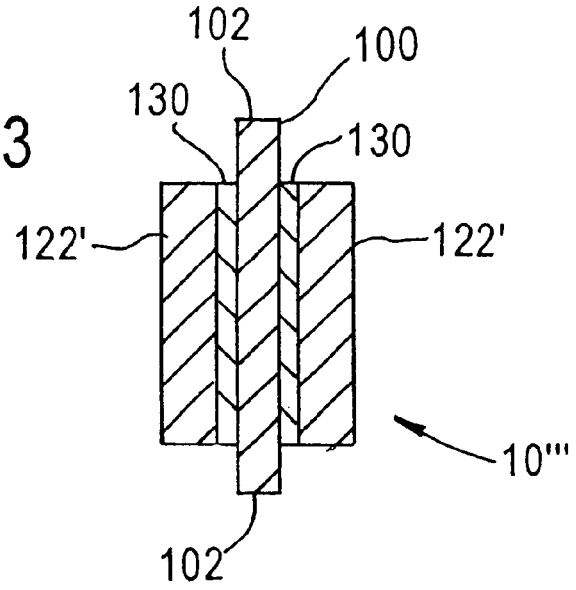
FIG. 3 is a cross-sectional view of the field emitter having the operating film side supporting films and an interface film with intermediate expansion coefficient.
Figure 4:
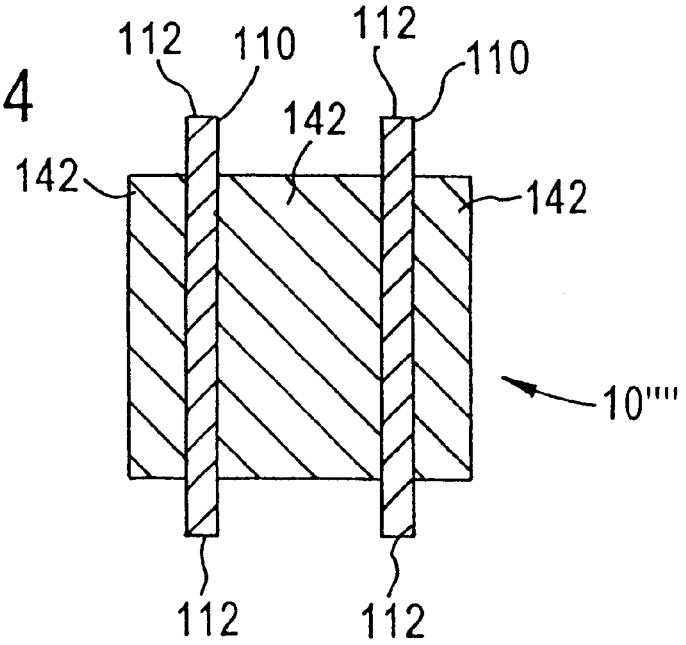
FIG. 4 is a cross-sectional view of a multi-film field emitter having operating films and supporting films.

The geometrical dimensions and the shape of all of the herein described arrangements of field emitters depend on particular applications and usually are determined by geometrical and operating characteristics of devices. However, regardless to device characteristics, the typical thickness of operating film is between 0.0001 and 10 $\mu$m and the typical thickness of supporting films is between 1 and 100 $\mu$m.

As depicted in FIGS. 1–4, the field emitter 10', 10", 10''', 10"" includes the operating film (100 in FIGS. 1–3 and 110 in FIG. 4), the ends (102 in FIGS. 1–3 and 112 in FIG. 4) each of which protrudes above the surface of the supporting films (120, 122, 122' in FIGS. 1–3 and 142 in FIG. 4) applied on its side surfaces. These supporting films 120, 122, 122', 142 have a coefficient of linear expansion the same or close to that of the operating film 100, 110. The supporting film 120, 122, 122', 142 allow operation of the field emitter 10', 10", 10''', 10"" to be used in a wide range of temperatures, keep its geometry and carry off heat from the operating film 100, 110 during its operation more effectively. The supporting film 120, 122, 122', 142 also prevent a thermal diffusion of corrosively active materials contacting with the emitter 10', 10", 10''', 10"".

All of the field emitters for microwave devices operate in the following way as described and depicted in patent application Ser. Nos. 09/380,247 and 09/380,248. A positive potential is applied to the anode of the device. A negative potential is applied to the filed emitter. When a potential reaches a necessary value, the field emitter starts to emit electrons, which go to the interaction space between the cathode and the anode. As described and illustrated herein, FIGS. 1 to 4 show completed structures and FIGS. 5 and 6 show the method of production of the field emitters of FIGS. 1–4. FIG. 5*e* corresponds to FIG. 1 and FIG. 6*i* corresponds to FIG. 2.

Figure 5A:
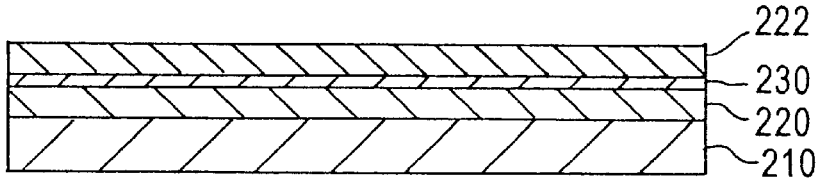
FIGS. 5*a*–5*e* are illustrations of a first series of depositing and etching processes used in forming field emitters according to the present invention.
Figure 5B:
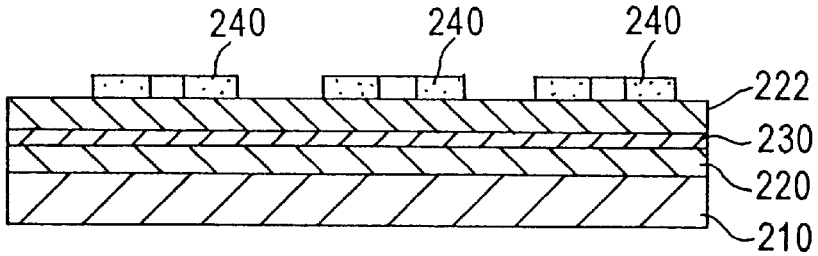
Figure 5C:
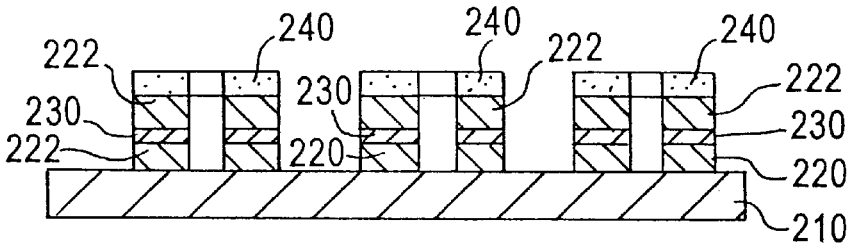
Figure 5D:
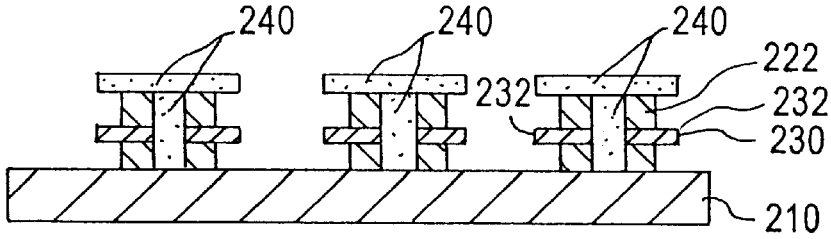
Figure 5E:
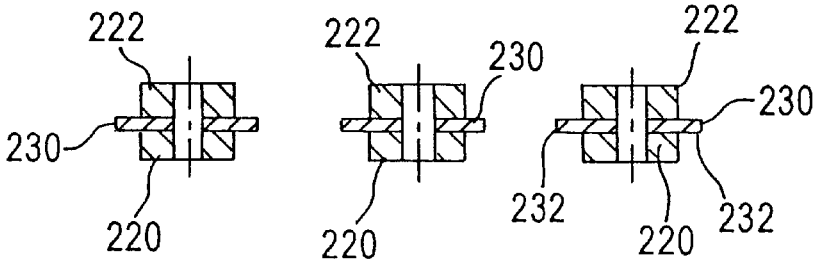

One method of manufacturing a field emitter according to the present invention is depicted in FIGS. 5A–5*e*. A film 220 of material with the expansion coefficient close to that of an operating film 230 and the operating film 230 itself are deposited sequentially using vacuum deposition on a substrate 210 in a vacuum chamber. As depicted in FIG. 5*a*, then, without opening of the chamber, a film 222 of the same material as film 220 onto the operating film 230 is deposited. As depicted in FIG. 5*b*, a protective mask 240 protecting layers underneath (222, 230, 220) from etching is deposited on the finished film structure. As depicted in FIG. 5*c*, then, the etching of the structure down to the substrate 210 is carried out by ion-beam etching. As depicted in FIG. 5*d*, to form the operating structure of the end of the filed emitter, exposed vertical and horizontal areas are protected by a photoresist 240 in such a way that only the operating edge 232 of the film 230 of the field emitter is not protected. The etching of the films 222, 220 by selective etching down to the defined level is carried out after that as depicted in FIG. 5*d*. The protective film 240 is removed from the formed structure and the structure itself is detached from the substrate 210 as depicted in FIG. 5*e*. The materials used are as follows: 210 is aluminum, 220 and 222 are vanadium, and 230 is tantalum.

Figure 6A:
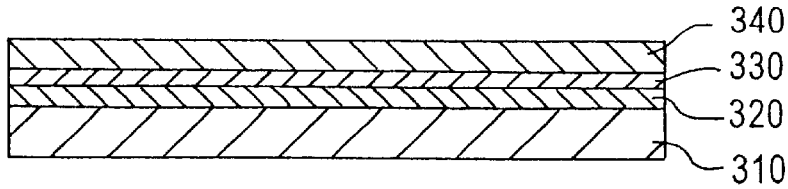
FIGS. 6*a*–6*i* are illustrations of a second series of depositing and etching processes used in forming field emitters according to the present invention.
Figure 6B:
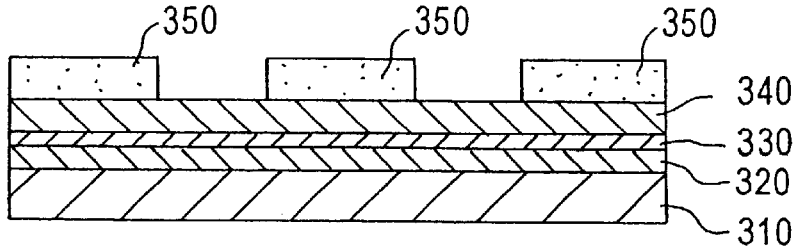
Figure 6C:
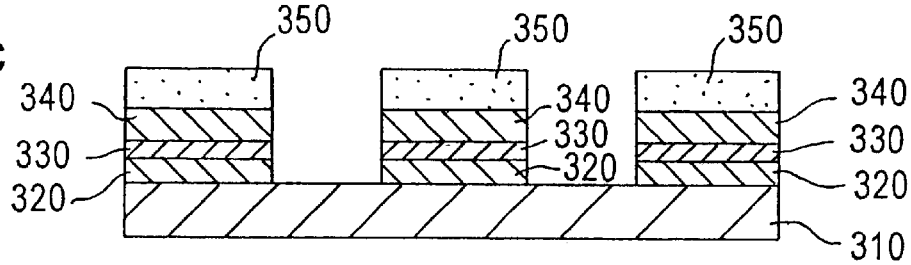
Figure 6D:
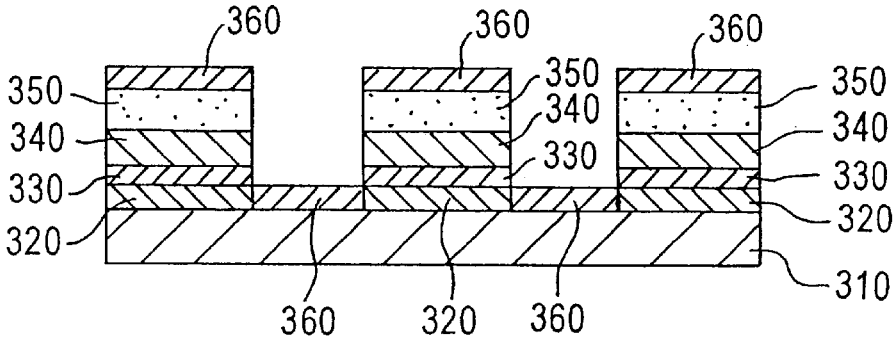
Figure 6E:
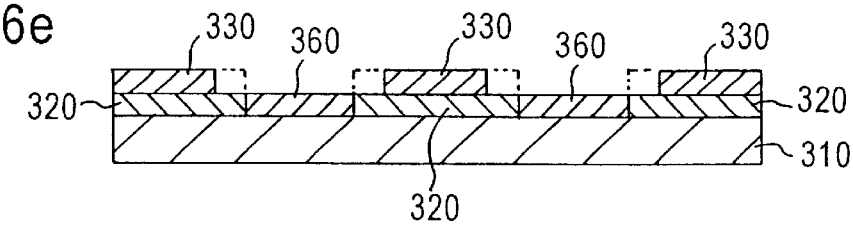
Figure 6F:
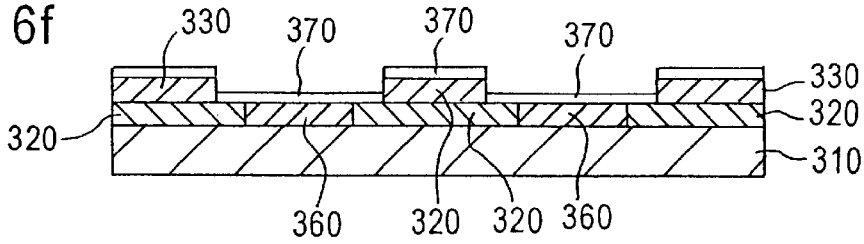
Figure 6G:
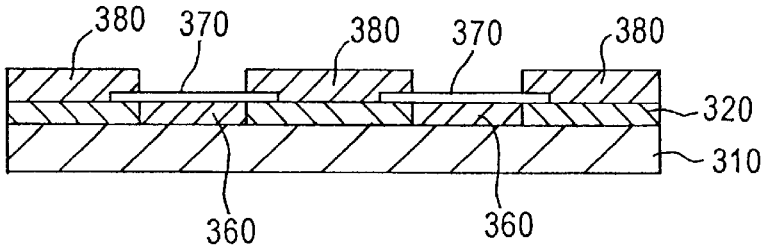
Figure 6H:
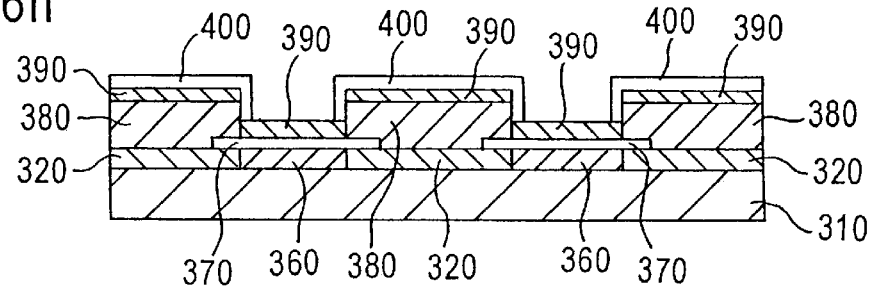
Figure 6I:
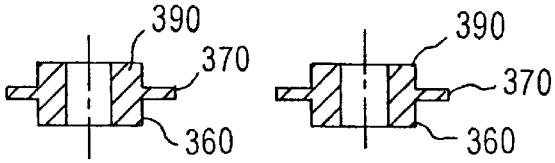

As depicted in FIGS. 6*a*–6*i*, another method of manufacturing field emitters according to the present invention is depicted. As depicted in FIG. 6*a*, a three-layer film of selective etching materials 320, 330 and 340 is deposited on a substrate 310. As depicted in FIG. 6*b*, a protective mask 350 is formed on the created structure and then ion etching of films 340, 330 and 320 down to the substrates 310 is carried out as depicted in FIG. 6*c*. As depicted in FIG. 6*d*, the film 360 made of the same material, as later operating film 370, is deposited on horizontal surfaces. As depicted in FIG. 6*e*, the partial etching of the film 330 is carried out and the film 340 along with the films 350, 360 is removed. As depicted in FIG. 6*f*, the operating film of the field emitter 370 is deposited on the remaining structure. Then, as depicted in FIG. 6*g*, the films 330 and 370 are removed, the layer 380 is sputtered on, where windows are shaped according to arrangement of the layer 360 in the second layer 320, and the thicker film 390, made of the same material that operating film 370 is made, is deposited. As depicted in FIG. 6*h*, the protective mask of chromium 400 is deposited on the obtained structure, through which mask the holes in the films 320, 370, and 390 are made by plasma-chemical etching. After that the films 310, 320, and 380 are removed chemically in a selective etcher. The ready field emitter (stage 6*i*) is a multi-layer structure made of the same material. The materials used in the FIG. 6 embodiment are as follows: 310 is molybdenum, 320 is vanadium, 330 is aluminum, 340 is copper, 350 is chromium, 360 is tantalum, 370 is tantalum, 380 is vanadium, 390 is tantalum, 400 is chromium.

The production of other designs of field emitters is similar to both of the described methods and differs only by a number of deposited films. Of course, although both described methods produced three field emitters, any number of field emitters can be produced on a substrate.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A method of manufacturing a field emitter for a magnetron, comprising:

depositing three layers of film on a substrate;

placing at least one protective mask on an uppermost layer of the three layers;

first removing portions of the three layers not protected by the at least one protective mask;

exposing horizontal and vertical portions of the first and third layers of the remaining three layers and removing opposite edges of the remaining first and third layers; and second removing the at least one protective mask and the substrate to form at least one field emitter.

2. The method of claim 1, wherein the first layer is vanadium.

3. The method of claim 1, wherein the second layer is tantalum.

4. The method of claim 1, wherein the third layer is vanadium.

5. The method of claim 1, wherein the depositing step is performed using vacuum deposition.

6. The method of claim 1, wherein the step of first removing is by etching and the step of second removing is by ion-beam etching.

7. The method of claim 1, wherein the protective mask is chromium.

8. A method of manufacturing a field emitter for a magnetron, comprising:

depositing three layers of film on a substrate;

placing at least one protective mask on an uppermost layer of the three layers;

first removing portions of the three layers not protected by the at least one protective mask to form a plurality of stacks of layers of film and to expose an upper surface of the substrate therebetween;

depositing a fourth layer of film onto an upper surface of the at least one protective mask and on the exposed upper surface of the substrate;

removing the layers of film and protective mask above the second layer;

partially removing a portion on the second layer of film to expose a portion of the upper surface of the second layer;

depositing a fifth layer of film on the remaining partially etched layer, the portions of the upper surface of the second layer, and an upper surface of the fourth layer;

removing the partially etched layer and the layer of film above the partially etched layer;

depositing a sixth layer on the upper surface of the first layer and on a portion of the fourth layer;

depositing a seventh layer of film on an upper surface of the sixth layer of film; and removing all layers except for the fourth layer, the fifth layer and the seventh layer.

9. The method of claim 8, wherein the removing steps are etching.

10. The method of claim 8, comprising the step of forming a protective layer on an upper surface of the seventh layer and edges of the sixth layer and forming a hole through the fourth, fifth and seventh layers.

11. The method of claim 8, comprising the step of forming a hole through the fourth, fifth and seventh layers.

12. The method of claim 8, wherein the substrate is molybdenum, the first layer is vanadium, the second layer is aluminum, the third layer is copper, the fourth layer is tantalum, the fifth layer is tantalum, the sixth layer is vanadium and the seventh layer is tantalum.

13. The method of claim 8, further comprising partially etching the second layer.

* * * * *